US009261840B2

(12) United States Patent
Saito

(10) Patent No.: US 9,261,840 B2
(45) Date of Patent: Feb. 16, 2016

(54) METHOD OF DETERMINING PROCESS CONDITION OF IMAGE FORMING APPARATUS

(71) Applicant: CANON KABUSHIKI KAISHA, Tokyo (JP)

(72) Inventor: Makoto Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/452,723

(22) Filed: Aug. 6, 2014

(65) Prior Publication Data

US 2015/0055965 A1 Feb. 26, 2015

(30) Foreign Application Priority Data

Aug. 22, 2013 (JP) ..... 2013-172666

(51) Int. Cl.
*G03G 15/00* (2006.01)

(52) U.S. Cl.
CPC .. *G03G 15/5041* (2013.01); *G03G 2215/00067* (2013.01)

(58) Field of Classification Search
CPC ..... G03G 15/5041; G03G 2215/00067
USPC ..... 399/15, 50, 55, 72
See application file for complete search history.

(56) References Cited

U.S. PATENT DOCUMENTS 6,034,788 A 3/2000 Sasanuma et al.
8,705,137 B2 * 4/2014 Zaima ..... G06K 15/027 358/1.13
2002/0067494 A1 * 6/2002 Furuya ..... B41J 29/393 358/1.9
2007/0229923 A1 * 10/2007 Itagaki ..... H04N 1/00002 358/504
2008/0124115 A1 * 5/2008 Oki ..... 399/74
2011/0222869 A1 * 9/2011 Sakatani ..... G03G 15/5062 399/15
2013/0278951 A1 * 10/2013 Makino ..... 358/1.9
2015/0063843 A1 3/2015 Saito

FOREIGN PATENT DOCUMENTS

JP 07-261479 A 10/1995

* cited by examiner

*Primary Examiner* — Francis Gray
(74) *Attorney, Agent, or Firm* — Fitzpatrick, Cella, Harper & Scinto

(57) ABSTRACT

An image forming unit forms a plurality of measurement images based on a plurality of process conditions. A measurement unit measures the density of each of the plurality of measurement images. A determination unit uses a first determination mode or a second determination mode. In the first determination mode, a process condition is determined from a first measurement result higher than target density and a second measurement result lower than the target density, from among a plurality of measurement results. In the second determination mode, the process condition is determined from measurement results lower than the target density.

20 Claims, 11 Drawing Sheets

METHOD OF DETERMINING PROCESS CONDITION OF IMAGE FORMING APPARATUS

BACKGROUND OF THE INVENTION

1. Field of the Invention

The present invention relates to an image forming apparatus such as a copier or a printer that uses an electrophotographic scheme, an electrostatic recording scheme, or the like, and a control method for the image forming apparatus.

2. Description of the Related Art

An image forming apparatus corrects, based on a result of measuring a measurement image, the density and gradation characteristics of an image formed by the image forming apparatus, to adjust the image quality to desired quality. This process is called calibration. The U.S. Pat. No. 6,034,788 proposes calibration in which a charging voltage or a developing voltage is controlled to correct maximum image density, and a gradation correction condition is changed to correct gradation characteristics.

In recent years, the market has demanded expansion of the color gamut of image forming apparatuses. The color gamut can be expanded by increasing the single-color maximum density of each of cyan, magenta, yellow, and black. For example, to increase the maximum density of each of cyan, magenta, yellow, and black, a measurement image of each of cyan, magenta, yellow, and black is formed, and a process condition for forming an image of the maximum density is determined based on a result of measuring the measurement image using a sensor. There is, however, the problem of the measurement result of the sensor being saturated in the case where the amount of toner (the amount of applied toner) attached to the measurement image exceeds a predetermined amount. In the case where the measurement result obtained by reading the measurement image is saturated, the measurement result no longer increases monotonically even when the amount of applied toner on a sheet is increased. In calibration, the relation between a measurement result obtained by reading a pattern image and a process condition (laser power, charging potential, developing potential, etc.) used when forming the pattern image needs to be determined accurately. A failure to accurately determine the relation between the amount of applied toner and the measurement result leads to lower calibration accuracy. A possible cause of the saturation of the measurement result is that, when the amount of pigment included in the toner is greater than or equal to a predetermined amount, light cannot pass through or reflect off the measurement image.

SUMMARY OF THE INVENTION

The present invention accurately determines the process condition even when the measurement result is saturated.

The present invention may provide an image forming apparatus comprising the following elements. An image forming unit is configured to form an image based on a process condition. A control unit is configured to control the image forming unit to form a plurality of measurement images based on a plurality of process conditions. A measurement unit is configured to measure density of each of the plurality of measurement images. A determination unit is configured to determine a process condition for the image forming unit to form an image of target density, using a determination mode which includes a first determination mode in which the process condition for the image forming unit to form an image of target density is determined from a first measurement result higher than the target density and a second measurement result lower than the target density, from among a plurality of measurement results of the measurement unit, and a second determination mode in which the process condition for the image forming unit to form an image of target density is determined from measurement results lower than the target density, from among the plurality of measurement results of the measurement unit.

Further features of the present invention will become apparent from the following description of exemplary embodiments (with reference to the attached drawings).

DESCRIPTION OF THE EMBODIMENTS

The following describes an image forming apparatus according to the present invention in more detail, with reference to drawings. In this embodiment, n pattern images (n is a natural number greater than or equal to 3) respectively corresponding to n parameters are formed on a sheet, and linear interpolation is applied in a monotonic increase region of n density values for the n parameters used when forming the corresponding n pattern images, to determine a parameter corresponding to a target density value. In other words, linear interpolation is performed excluding any density value in a non-monotonic increase region from among the n density values, as a result of which the process condition can be accurately determined even when the measurement result for the amount of applied toner is saturated.

[Overall Structure of Image Forming Apparatus]

Figure 1:
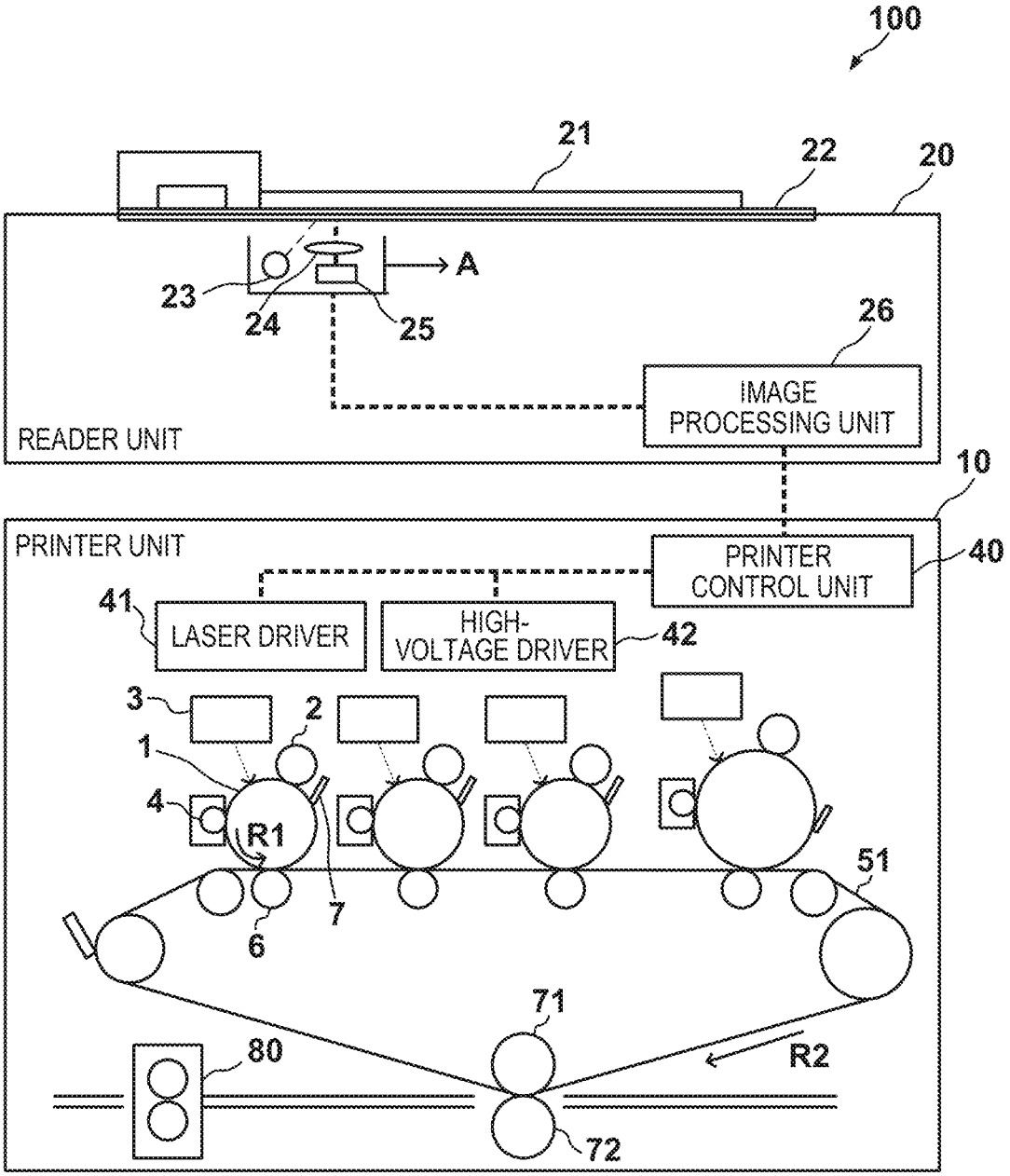
FIG. 1 is a schematic sectional view of an image forming apparatus.

FIG. 1 is a schematic sectional view of an image forming apparatus 100. The image forming apparatus 100 is a copier that forms a multicolor image on a sheet (recording paper, OHT sheet, cloth, resin, etc.) using an electrophotographic scheme, and includes a printer unit 10 and a reader unit 20.

The printer unit 10 includes first, second, third, and fourth image forming units (stations) respectively for forming images of yellow, magenta, cyan, and black, each as an image forming unit that forms a toner image. Each image forming unit has the same structure, except the color of the toner used. A printer control unit 40 controls a laser driver 41, a high-voltage driver 42, and the four image forming units, based on an image signal output from the reader unit 20.

Each image forming unit includes a photosensitive drum 1 which is a cylindrical photosensitive member, as an image carrier. The photosensitive drum 1 rotates in the direction of arrow R1. The surface of the photosensitive drum 1 is charged to a uniform potential by a charging roller 2 as a charging unit. The high-voltage driver 42 supplies a predetermined charging voltage to the charging roller 2. A laser beam scanner 3 as an exposure unit irradiates the surface of the photosensitive drum 1 with a light beam whose light intensity is controlled by the laser driver 41, to form an electrostatic latent image. A developer 4 as a developing unit is supplied with a predetermined developing voltage from the high-voltage driver 42, and attaches toner to the electrostatic latent image to develop a toner image (visible image). The toner image is primary-transferred to an intermediate transfer belt 51 by a primary transfer roller 6. Toner remaining without being primary-transferred is removed from the surface of the photosensitive drum 1, by a cleaning device 7 as a cleaning unit. The toner image formed on the intermediate transfer belt 51 is secondary-transferred to a sheet by a secondary transfer roller pair (an inner roller 71 and an outer roller 72). The toner image secondary-transferred to the sheet is fixed to the sheet by a fixing device 80.

The reader unit 20 is an image scanner. A light source 23 irradiates an original 21 placed on a platen 22, with illumination light. Light reflected from the original 21 forms an image on a CCD sensor 25 via an optical system 24 such as a lens. The CCD sensor 25 is an image sensor that outputs an image signal corresponding to the light reflected from the original 21. In particular, the intensity of light reflected from a toner image indicates the reflection density (luminance value) of the toner image. A reading unit composed of the light source 23, the optical system 24, and the CCD sensor 25 moves in the direction of arrow A (sub-scanning direction) shown in FIG. 1, to scan the entire original 21. An image processing unit 26 converts the analog image signal output from the CCD sensor 25 to a digital image signal, to generate image data. The image processing unit 26 converts the image data of RGB (red, green, blue) to image data of YMCK, and outputs the image data to the printer control unit 40.

The following describes process condition control which is a feature of the present invention. In this embodiment, to adjust solid density to desired density, the printer unit 10 forms a reference chart (pattern image) on a sheet, and the reader unit 20 reads the reference chart. Density correction is then carried out. This process is described below.

Figure 2:
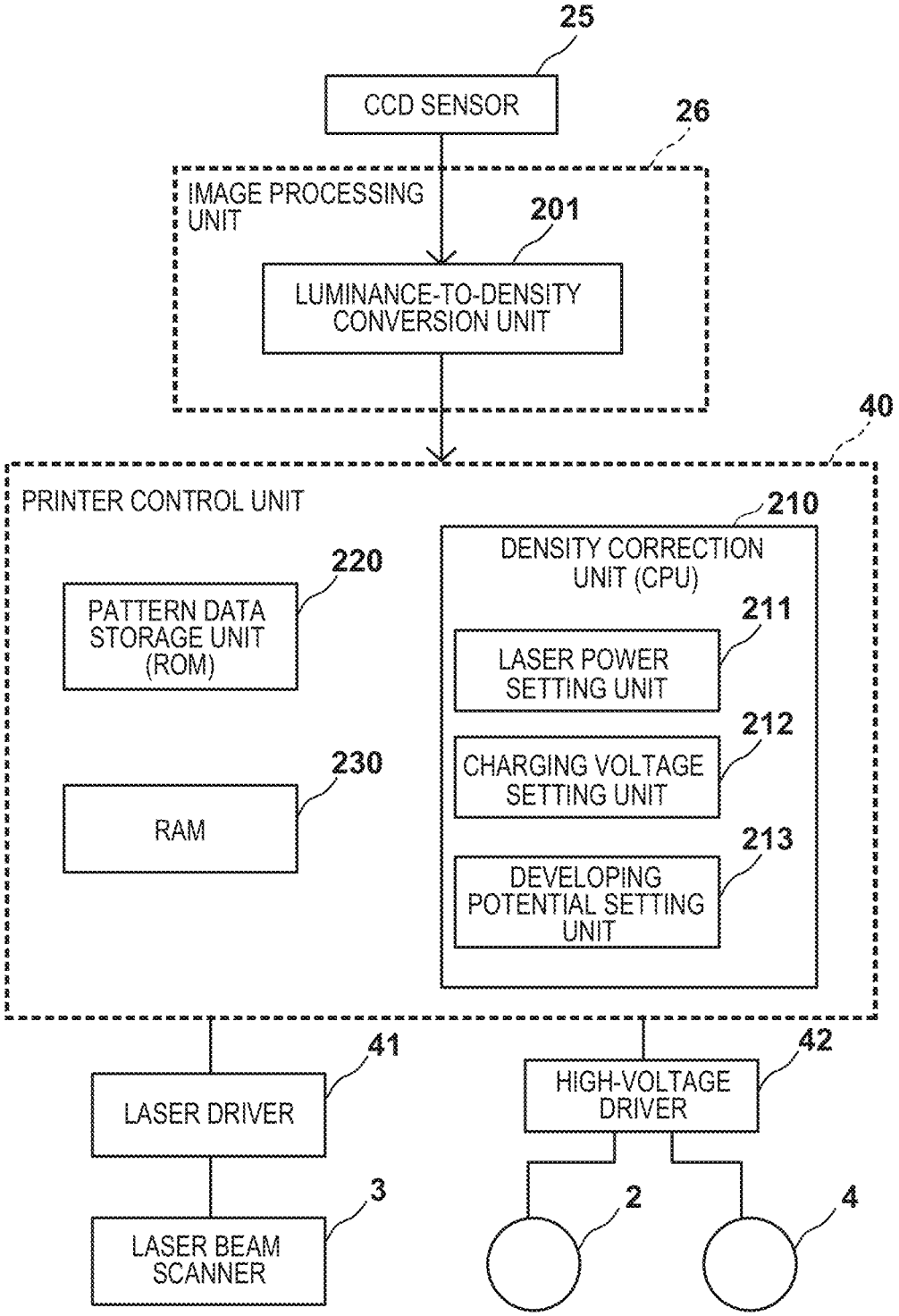
FIG. 2 is a block diagram showing functions relating to density correction.

FIG. 2 is a block diagram showing functions relating to density correction. The image processing unit 26 includes a luminance-to-density conversion unit 201 that converts the reflection density (luminance value) of the pattern image formed on the sheet, to a density value. The luminance-to-density conversion unit 201 converts the read data (luminance data) of the reader unit 20 to density data, using luminance-to-density conversion data stored in a ROM. The printer control unit 40 includes a CPU, the ROM, and a RAM 230. A density correction unit 210 is realized by the CPU executing a program stored in the ROM. The density correction unit 210 is a unit that determines a parameter for achieving desired image density. The density correction unit 210 may be realized by an application specific integrated circuit (ASIC), a digital signal processor (DSP), or the like.

The printer control unit 40 reads pattern image data stored in a storage unit 220, and controls the printer unit 10 using n different parameters (n is a natural number greater than or equal to 3), to form n pattern images on a sheet. For example, the printer control unit 40 varies the laser power, to form n toner images (n is a natural number greater than or equal to 3) different in density on the sheet. Thus, the n pattern images respectively corresponding to the n parameters are formed on the sheet. The types of parameters for determining the amount of applied toner on the sheet include the laser power, the charging voltage, and the developing potential. One of these parameters is controlled in n levels, while the other parameters are fixed.

A laser power setting unit 211 is a unit that sets the laser power which is one of the parameters, in the laser driver 41. For example, the laser power setting unit 211 sequentially sets n laser powers from the first to nth levels in the laser driver 41, based on pattern image data or other control data. The laser driver 41 controls the laser beam scanner 3 so that a light beam corresponding to the set laser power is output. As a result, electrostatic latent images corresponding to toner images different in image density are formed on the surface of the photosensitive drum 1. A charging voltage setting unit 212 sequentially sets n charging potentials from the first to nth levels in the high-voltage driver 42, based on pattern image data or other control data. The high-voltage driver 42 applies the set charging potential to the charging roller 2. As a result, electrostatic latent images corresponding to toner images different in image density are formed on the surface of the photosensitive drum 1. A developing potential setting unit 213 sequentially sets n developing potentials from the first to nth levels in the high-voltage driver 42, based on pattern image data or other control data. The high-voltage driver 42 applies the set developing potential to a developing sleeve of the developer 4. As a result, electrostatic latent images corresponding to toner images different in image density are formed on the surface of the photosensitive drum 1.

Thus, the printer unit 10 functions as a pattern image forming unit that forms n pattern images (n is a natural number greater than or equal to 3) respectively corresponding to n parameters on a sheet. The reader unit 20 functions as a reading unit that reads n pattern images formed on the sheet and obtains corresponding n pieces of read data (luminance values). The luminance-to-density conversion unit 201 functions as a conversion unit that converts the n pieces of read data (luminance values) to n pieces of density data. The density correction unit 210 functions as a determination unit that determines a region in which n pieces of density data for the n parameters monotonically increase and, based on density data in the determined region, determines a parameter corresponding to a target density value. The operation of the density correction unit 210 will be described in detail later.

Figure 3:
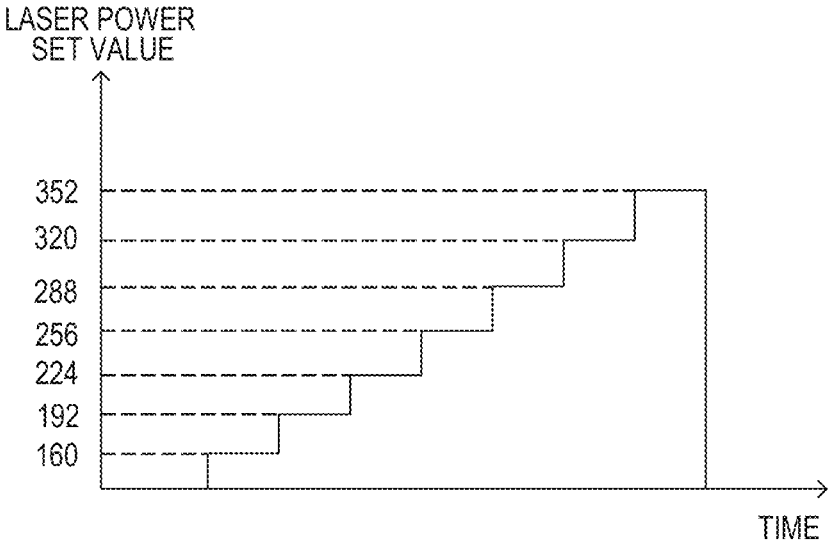
FIG. 3 is a diagram showing an example of setting laser power set values.
Figure 4:
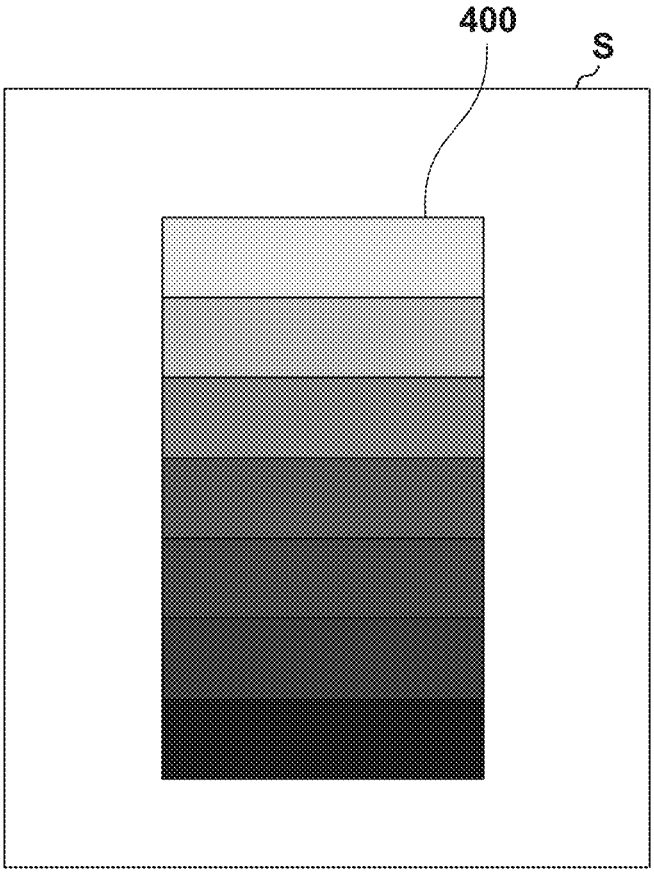
FIG. 4 is a diagram showing an example of a pattern image.

The following describes the operation of the image forming apparatus 100. Here, the surface of the photosensitive drum 1 is charged to a predetermined dark potential, and a predetermined developing voltage is applied to the developing sleeve of the developer 4. The high-voltage driver 42 generates the charging voltage so that the dark potential is −700 V, and generates the developing voltage so that the DC component of the developing potential is −600 V. In this state, the laser power setting unit 211 varies the laser power in 7 levels in an A3 size image, as shown in FIG. 3. The image forming unit forms 7 pattern images. The laser power can be set with a resolution of 9 bits. Hence, the maximum set value of the laser power is 512. The laser power set values in 7 levels are 160, 192, 224, 256, 288, 320, and 352. FIG. 4 shows an example of a pattern image 400 formed on a sheet S. The pattern image 400 includes 7 pattern images having the same shape. The 7 pattern images respectively correspond to the laser power set values of the first to seventh levels, and differ in density.

The pattern image 400 on the sheet S output from the printer unit 10 is set on the platen 22 and read by the reader unit 20. The luminance-to-density conversion unit 201 in the reader unit 20 converts luminance data of each pattern image to density data, and outputs the density data to the printer control unit 40.

Figure 5:
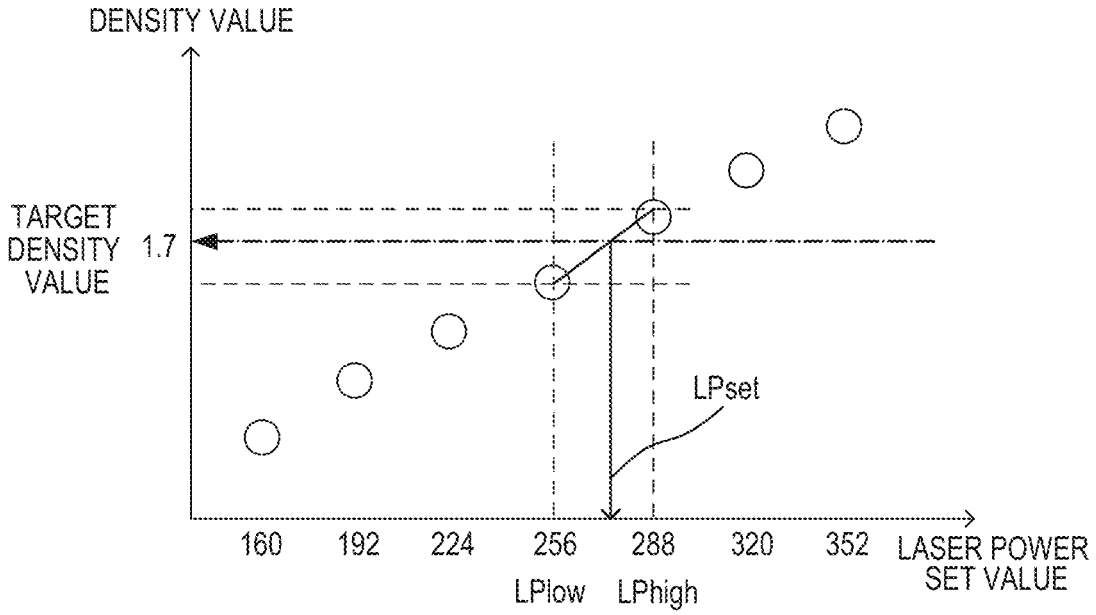
FIG. 5 is a diagram showing relations between parameters and measured density values.

The density data of each of the 7 pattern images is stored in association with the laser power set value used when forming the pattern image, as shown in FIG. 5. The laser power setting unit 211 compares the density data (measured density value) of each pattern image with target density data (target density value), and determines a measured density value exceeding the target density value. For example, in order from the lowest laser power set value (160) to the highest laser power set value (352) of the 7 laser power set values, the laser power setting unit 211 compares the corresponding measured density value with the target density value. Let LPhigh be a laser power set value corresponding to a measured density value that first exceeds the target density value, and LPlow be a laser power set value one level lower than LPhigh. The laser power setting unit 211 performs linear interpolation (interpolation) between the two points LPlow and LPhigh, to calculate a laser power set value LPset for achieving the target density value. LPhigh is an example of a first measurement result higher than target density. LPlow is an example of a second measurement result lower than target density. The laser power set value LPset is an example of a process condition for the image forming unit to form an image of target density. The above-mentioned method of determining the laser power set value LPset is referred to as "first determination mode".

In FIG. 5, the target density value is 1.7. Though a typical target density value has been about 1.6, the target density value is set to 1.7 here to expand the color gamut. These values are merely examples. The laser power set value determination method described with reference to FIG. 5 is the most basic determination method applicable under ideal condition where the measured density value is not saturated.

Figure 6:
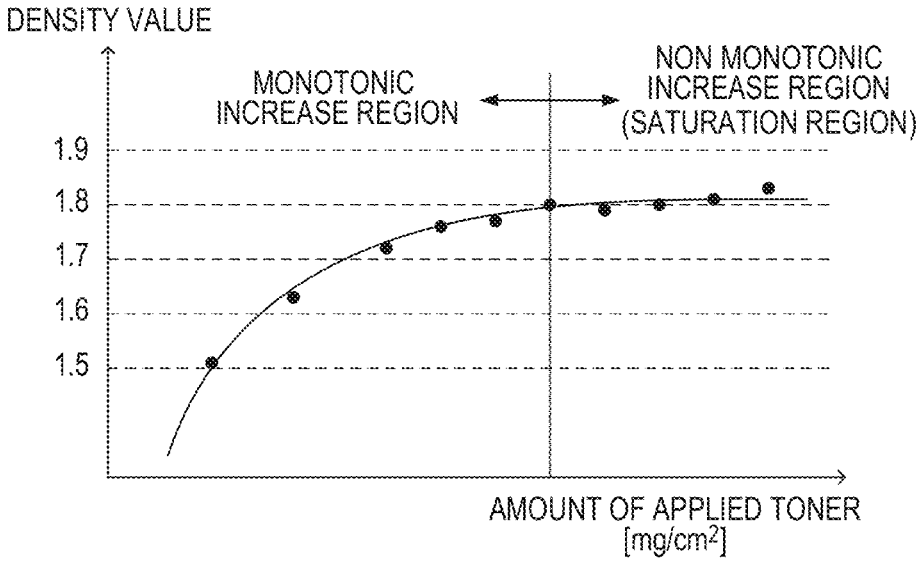
FIG. 6 is a diagram showing relations between amounts of applied toner and measured density values.

FIG. 6 is a diagram showing an example of the density data with respect to the amount of applied toner. Here, high white paper GF-C081 (81.4 g/m2 in basic weight) made by Canon Inc. is used as the sheet S. The pattern image 400 is formed in black as a single color. As shown in FIG. 6, when the amount of applied toner is increased by adjusting the parameter, the measured density value obtained by the reader unit 20 increases. When the amount of applied toner exceeds a predetermined amount, however, the measured density value is saturated. Especially in relatively high levels of laser power, the measured density value of the pattern image does not increase despite the amount of applied toner being increased by raising the laser power set value. In FIG. 6, a region in which the measured density value increases when the laser power set value increases is referred to as "monotonic increase region", and a region in which the measured density value does not increase even when the laser power set value increases is referred to as "non monotonic increase region" (outside the monotonic increase region, or a saturation region).

As mentioned earlier, linear interpolation is used in the method of determining the laser power set value for achieving the target density value. If linear interpolation is performed using the measured density value included in the non-monotonic increase region shown in FIG. 6 and the laser power set value is determined based on the calculation result, the determined laser power set value lacks accuracy.

Accordingly, in this embodiment, the laser power setting unit 211 distinguishes among three cases (a), (b), and (c), and switches the laser power set value calculation method based on the result of distinguishment. In other words, linear interpolation is applied in the monotonic increase region of the n measured density values for the n parameters, to determine the parameter set value corresponding to the target density value. Linear interpolation is thus performed excluding any measured density value in the non-monotonic increase region from among the n measured density values, as a result of which the process condition can be accurately determined even when the measured density value for the amount of applied toner is saturated. The following describes the laser power set value determination method in detail.

Case (a)

Figure 7:
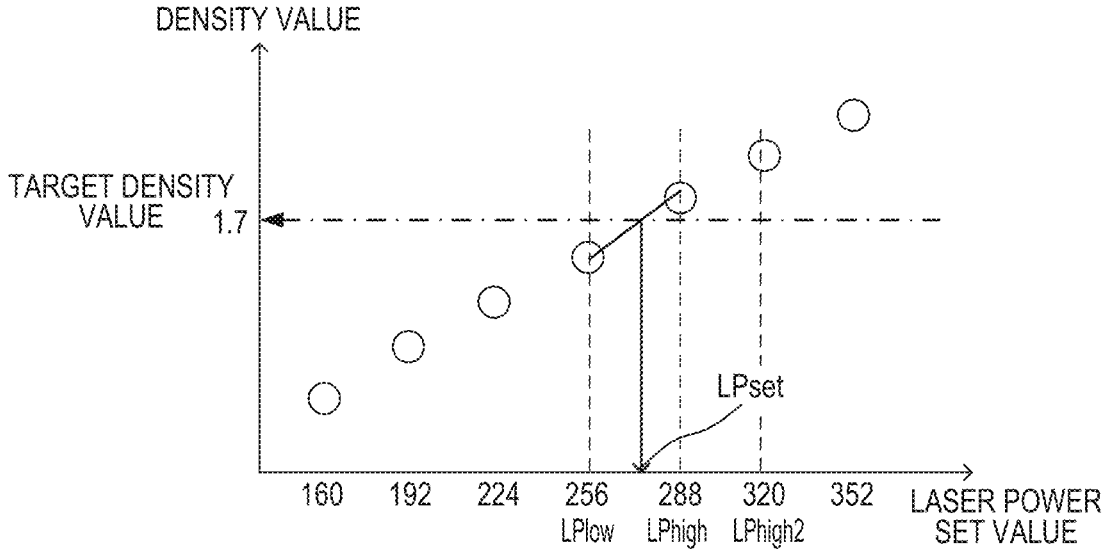
FIG. 7 is a diagram showing a method of determining a parameter for achieving a target density value.

As shown in FIG. 7, let LPhigh2 be a laser power set value one level higher than LPhigh. The density value corresponding to LPhigh and the density value corresponding to LPhigh2 are compared with each other. The measured density value of the pattern image 400 is obtained by the luminance-to-density conversion unit 201 converting the read data (luminance data) of the pattern image 400. The density correction unit 210 compares the measured density value of the pattern image formed using LPhigh2 and the measured density value of the pattern image formed using LPhigh. In the case where the measured density value of the pattern image formed using LPhigh2 is higher than the measured density value of the pattern image formed using LPhigh, the density correction unit 210 determines that the measured density value corresponding to the amount of applied toner is not included in the saturation region. In the case where the measured density value of the pattern image formed using LPhigh2 is not higher than the measured density value of the pattern image formed using LPhigh, the density correction unit 210 determines that the measured density value corresponding to the amount of applied toner is included in the saturation region. In the example shown in FIG. 7, the measured density value of the pattern image formed using LPhigh2 is not included in the saturation region. In such a case, the laser power setting unit 211 performs interpolation (linear interpolation) between the two points LPlow and LPhigh, to determine the laser power set value LPset for achieving the target density value. This means LPset is determined according to the first determination mode.

Case (b)

Figure 8:
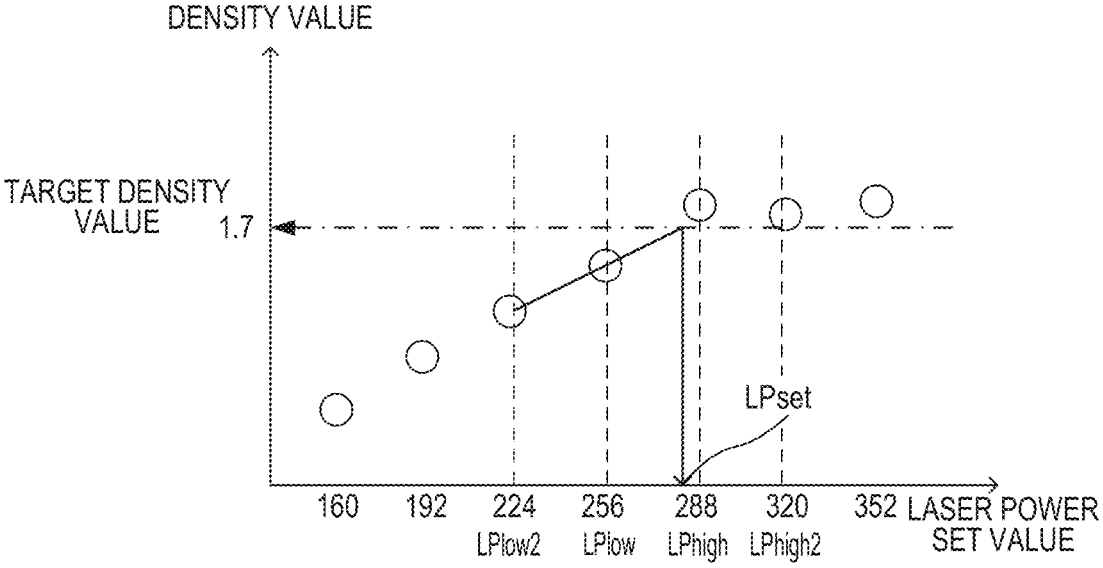
FIG. 8 is a diagram showing a method of determining a parameter for achieving a target density value.

As shown in FIG. 8, in the case where the measured density value of the pattern image formed using LPhigh2 is lower than the measured density value of the pattern image formed using LPhigh, the laser power setting unit 211 determines the laser power set value by the following procedure. The density correction unit 210 determines that the measured density value corresponding to LPhigh and the measured density value corresponding to LPhigh2 are included in the saturation region. The use of the measured density value included in the saturation region makes it impossible to accurately calculate the laser power set value for achieving the target density value, as mentioned above. The laser power setting unit 211 accordingly performs extrapolation (linear interpolation) using two points: a laser power set value LPlow2 one level lower than LPlow; and LPlow. The laser power setting unit 211 thus determines the laser power set value LPset for achieving the target density value. This is referred to as "second determination mode". The second determination mode is a mode in which the process condition for the image forming unit to form the image of the target density is determined from the measurement results LPlow2 and LPlow lower than the target density from among the plurality of measurement results.

Case (c)

Figure 9:
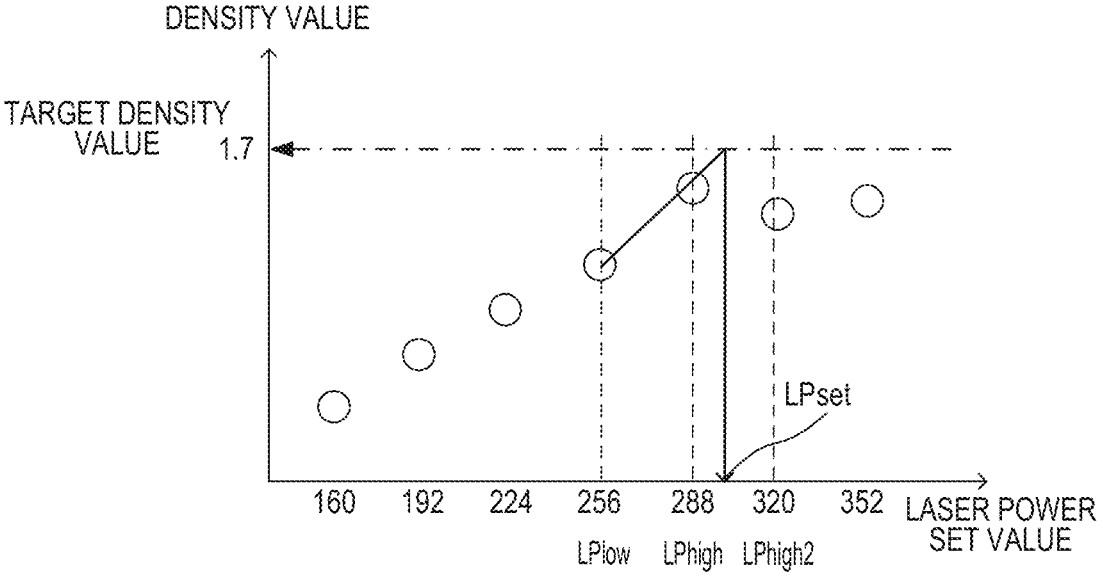
FIG. 9 is a diagram showing a method of determining a parameter for achieving a target density value.

As shown in FIG. 9, there is a possibility that all measured density values corresponding to the 7 laser power set values are lower than the target density value. This corresponds to the case (c). In the case (c), even when the amount of applied toner is increased by increasing the laser power set value, the measured density value is lower than the target density value. This may lead to an excessive increase of the laser power set value. In such a case, since the sheet carrying a large amount of toner passes through the fixing device, toner may stick to a fixing member (not shown) in the fixing device 80, causing a separation failure, i.e. the sheet cannot be separated from the fixing device 80. Hence, in the case (c), the laser power setting unit 211 determines the laser power set value LPset by the following procedure.

The laser power setting unit 211 determines whether or not the measured density value of a pattern image of interest is higher than the measured density value of a pattern image formed using a laser power set value one level higher than that of the pattern image of interest. The laser power setting unit 211 performs the determination, while sequentially changing the measured density value of the pattern image of interest in order from the measured density value corresponding to the lowest laser power set value to the measured density value corresponding to the highest laser power set value. The laser power setting unit 211 then determines a measured density value at which the change from the monotonic increase to the decrease occurs. In detail, in the case where the measured density value of the pattern image of interest is lower than the measured density value of the pattern image formed using the laser power set value higher than that of the pattern image of interest, the laser power set value of the pattern of interest is set as the laser power set value LPhigh. Further, the laser power set value of the pattern image formed using the laser power set value one level lower than that of the pattern of interest is set as the laser power set value LPlow. The laser power setting unit 211 performs extrapolation (linear interpolation) using the two points LPhigh and LPlow, to determine the laser power set value LPset for achieving the target density value. This is referred to as "third determination mode". Thus, in the case where the plurality of measurement results are lower than the target density, the process condition is determined from the measurement results lower than the target density.

Figure 10:
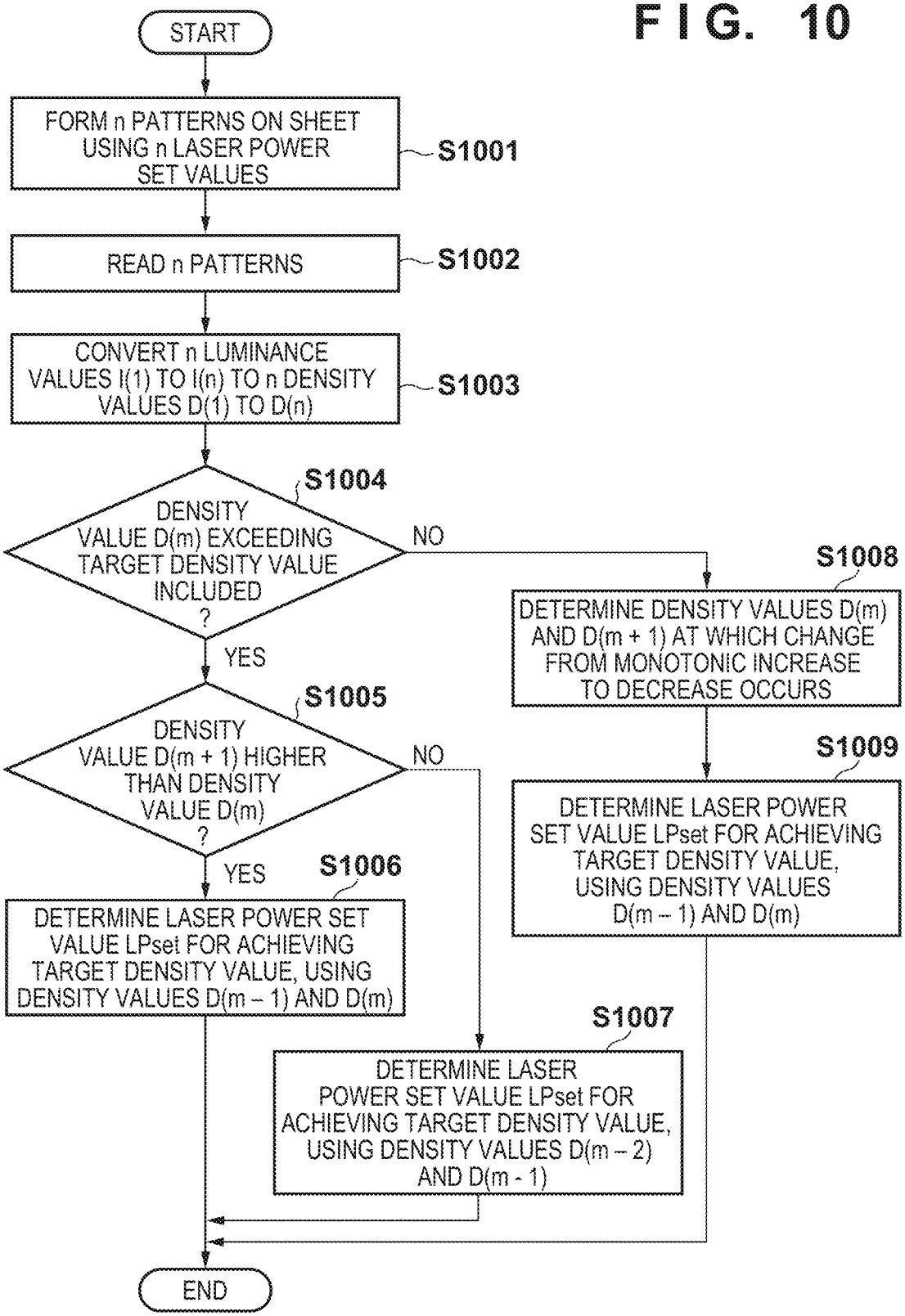
FIG. 10 is a flowchart showing a method of determining a parameter for achieving a target density value.

FIG. 10 is a flowchart showing the process of determining the laser power set value LPset for achieving the target density value, which is performed by the density correction unit 210. In S1001, the density correction unit 210 forms n pattern images using n laser power set values LP(1) to LP(n), on a sheet. For example, the density correction unit 210 reads pattern image data (n laser power set values LP(1) to LP(n)) for forming n pattern images from the storage unit 220, and sets the read data in the laser power setting unit 211. The laser power setting unit 211 sequentially sets the n laser power set values LP(1) to LP(n) in the laser driver 41. The laser driver 41 causes the laser beam scanner 3 to emit a light beam, while varying the laser power based on the n laser power set values LP(1) to LP(n). As a result, the electrostatic latent image corresponding to the pattern image 400 is formed on the photosensitive drum 1. The pattern image 400 of the electrostatic latent image developed by the developer 4 is primary-transferred to the intermediate transfer belt 51, and then secondary-transferred to the sheet S. The pattern image 400 on the sheet S is fixed to the sheet S by the fixing device 80. Thus, the printer unit 10 functions as a pattern image forming unit that forms n pattern images (n is a natural number greater than or equal to 3) respectively corresponding to n parameters on a sheet. In other words, the printer unit 10 varies the power of the light beam in n levels as the parameter, to form the n pattern images different in density on the sheet. The density correction unit 210 then waits until the operator places the sheet S on the reader unit 20 and the reader unit 20 reads the pattern image.

When the operator instructs the image forming apparatus 100 to read the pattern image 400, in S1002 the density correction unit 210 controls the reader unit 20 to read n pattern images included in the pattern image 400 formed on the sheet S. Thus, the reader unit 20 functions as a reading unit that reads n pattern images formed on the sheet to obtain corresponding n pieces of read data (luminance data). The CCD sensor 25 in the reader unit 20 outputs n luminance values I(1) to I(n) each for a different parameter, to the luminance-to-density conversion unit 201.

In S1003, the density correction unit 210 controls the luminance-to-density conversion unit 201 to convert the n pieces of read data (luminance data) I(1) to I(n) each for a different parameter, to n measured density values D(1) to D(n). Thus, the luminance-to-density conversion unit 201 functions as a conversion unit that converts n pieces of read data (luminance values) to corresponding n measured density values.

In S1004, the density correction unit 210 determines whether or not a density value D(m) exceeding the target density value is included in the n density values D(1) to D(n). Here, the density value D(m) is a density value that first exceeds the target density value, and corresponds to the density value of LPhigh shown in FIGS. 7 and 8. In the case where the density value D(m) exceeding the target density value is included, the density correction unit 210 proceeds to S1005.

In S1005, the density correction unit 210 determines whether or not the density value D(m+1) is higher than the density value D(m). The density value D(m+1) is the density value corresponding to the laser power set value LP(m+1) one level higher than the laser power set value LP(m) corresponding to the density value D(m). The laser power set value LP(m+1) corresponds to LPhigh2 mentioned above. In the case where the density value D(m+1) is higher than the density value D(m), the density correction unit 210 proceeds to S1006. This corresponds to the case (a).

In S1006, the density correction unit 210 performs linear interpolation using the density value D(m−1) and the density value D(m), to determine the laser power set value LPset corresponding to the target density value. The density value D(m−1) is the density value corresponding to the laser power set value LP(m−1) one level lower than the laser power set value LP(m) corresponding to the density value D(m). The density value D(m−1) is the density value corresponding to LPlow shown in FIG. 7. Here, m is a natural number greater than or equal to 2 and less than or equal to n−1.

In the case of determining in S1005 that the density value D(m+1) is not higher than the density value D(m), the density correction unit 210 proceeds to S1007. This corresponds to the case (b). In S1007, the density correction unit 210 performs linear interpolation using the density value D(m−2) and the density value D(m−1), to determine the laser power set value LPset corresponding to the target density value. The density value D(m−2) is the density value corresponding to the laser power set value LP(m−2) one level lower than the laser power set value LP(m−1) corresponding to the density value D(m−1). The density value D(m−2) corresponds to the density value of LPlow2 shown in FIG. 8. Here, m is a natural number greater than or equal to 3 and less than or equal to n−1.

In the case of determining in S1004 that the density value D(m) exceeding the target density value is not included, the density correction unit 210 proceeds to S1008. This corresponds to the case (c). In S1008, the density correction unit 210 determines the density values D(m) and D(m+1) at which the change from the monotonic increase to the decrease occurs, from among the n density values D(1) to D(n). In FIG. 9, the density value D(m) corresponds to the density value of LPhigh, and the density value D(m+1) corresponds to the density value of LPhigh2.

In S1009, the density correction unit 210 performs linear interpolation using the density value D(m−1) and the density value D(m), to determine the laser power set value LPset corresponding to the target density value. The density value D(m−1) is the density value corresponding to the laser power set value LP(m−1) one level lower than the laser power set value LP(m) corresponding to the density value D(m). In FIG. 9, LP(m−1) corresponds to LPlow.

Thus, the density correction unit 210 functions as a determination unit that applies linear interpolation in the monotonic increase region of the n density values for the n parameters used when forming the corresponding n pattern images, to determine the parameter corresponding to the target density value. The parameter is accurately determined in this way. The density correction unit 210 may perform linear interpolation excluding any density value in the non-monotonic increase region from among the n density values. The parameter is accurately determined by excluding the non-monotonic increase region. Since the maximum density value can be set accurately, it is possible to provide an image forming apparatus that ensures wide color gamut stably.

In the case (a), the density correction unit 210 determines the (m−1)th density value (m is a natural number greater than or equal to 2 and less than or equal to n−1) lower than the target density value and the mth density value higher than the target density value, from among the n density values. The density correction unit 210 also compares the (m+1)th density value higher than the mth density value and the mth density value, from among the n density values. In the case where the (m+1)th density value is higher than the mth density value, the density correction unit 210 performs linear interpolation using the (m−1)th density value and the mth density value, to determine the parameter corresponding to the target density value. The parameter can be accurately determined by using two density values in the monotonic increase region in this way.

In the case (b), the density correction unit 210 determines the (m−1)th density value (m is a natural number greater than or equal to 3 and less than or equal to n−1) lower than the target density value and the mth density value higher than the target density value, from among the n density values. The density correction unit 210 also compares the (m+1)th density value higher than the mth density value and the mth density value, from among the n density values. In the case where the (m+1)th density value is lower than the mth density value, the density correction unit 210 performs linear interpolation using the (m−2)th density value one level lower than the (m−1)th density value and the (m−1)th density value, to determine the parameter corresponding to the target density value. The parameter can be accurately determined by using two density values in the monotonic increase region in this way.

In the case (c), all of the n density values are lower than the target density value. In such a case, the density correction unit 210 performs linear interpolation using the last density value in the monotonic increase region and the density value one level lower than the last density value from among the n density values, to determine the parameter corresponding to the target density value. The parameter can be accurately determined by using two density values in the monotonic increase region in this way.

Embodiment 2

In Embodiment 1, the laser power is varied to form n pattern images different in density, while the charging potential (drum potential) and the developing potential are fixed. Embodiment 2 describes a parameter determination method in which the charging potential (drum potential) is varied to form n pattern images different in density, while the developing potential and the laser power are fixed. In other words, the charging voltage setting unit 212 varies the charging voltage in n levels as the parameter, as a result of which the printer unit 10 forms n pattern images different in density on a sheet.

Figure 11:
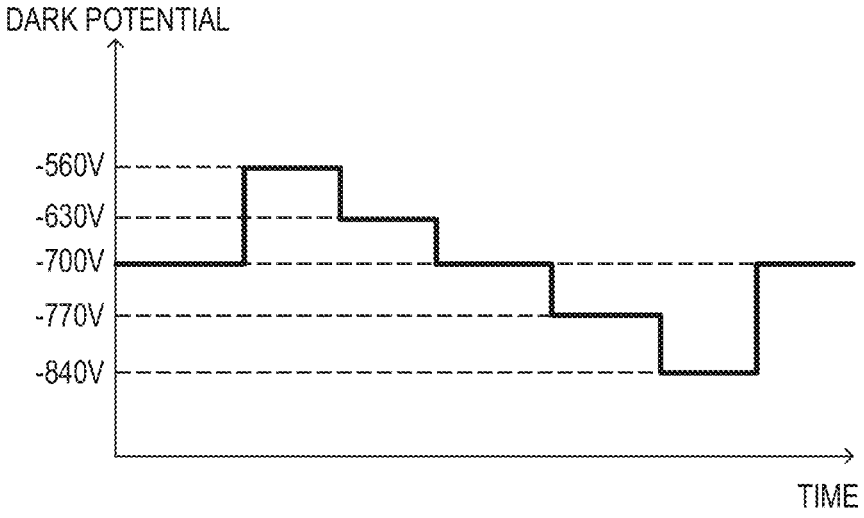
FIG. 11 is a diagram showing an example of setting dark potentials.

FIG. 11 is a diagram showing changes in dark potential corresponding to the charging voltage. The charging voltage setting unit 212 sequentially varies the charging voltage applied to the charging roller 2 so that the dark potential varies in 5 levels of −560 V, −630 V, −700 V, −770 V, and −840 V. When the dark potential is gradually decreased in this way, the density value of the pattern image increases.

Figure 12:
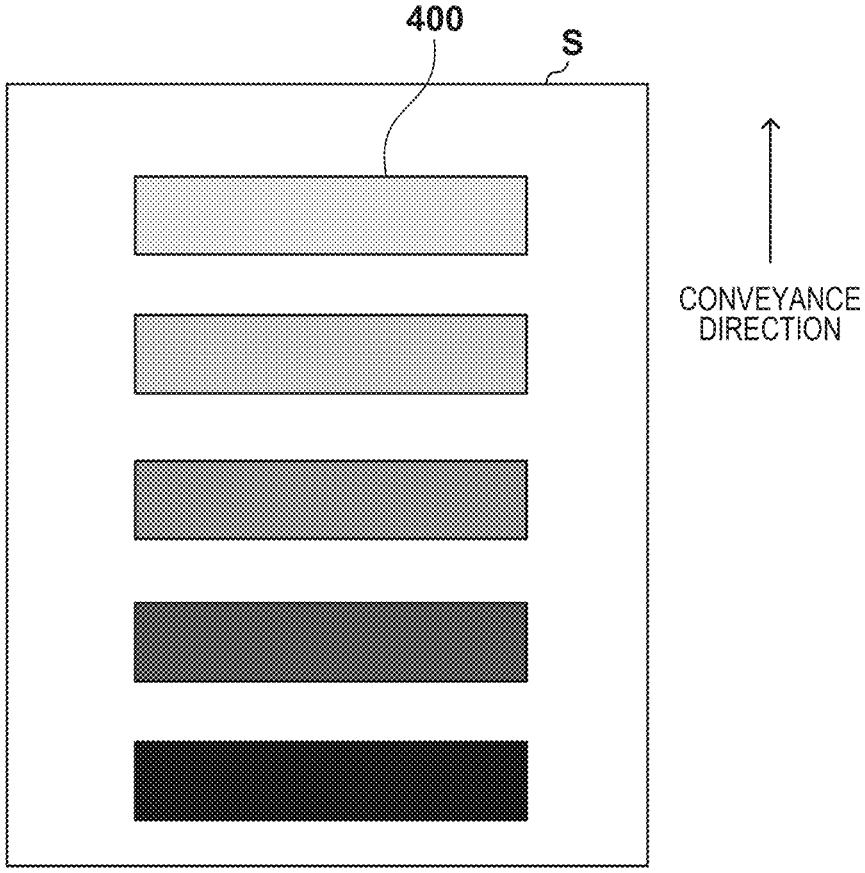
FIG. 12 is a diagram showing an example of a pattern image.

FIG. 12 is a diagram showing an example of a pattern image formed on a sheet. As shown in FIG. 12, a pattern image 400 made up of 5 pattern images is formed on an A3 size sheet S. The 5 pattern images correspond to the 5 dark potentials. A space is provided between adjacent pattern images, to reduce any influence from adjacent dark potentials.

Figure 13:
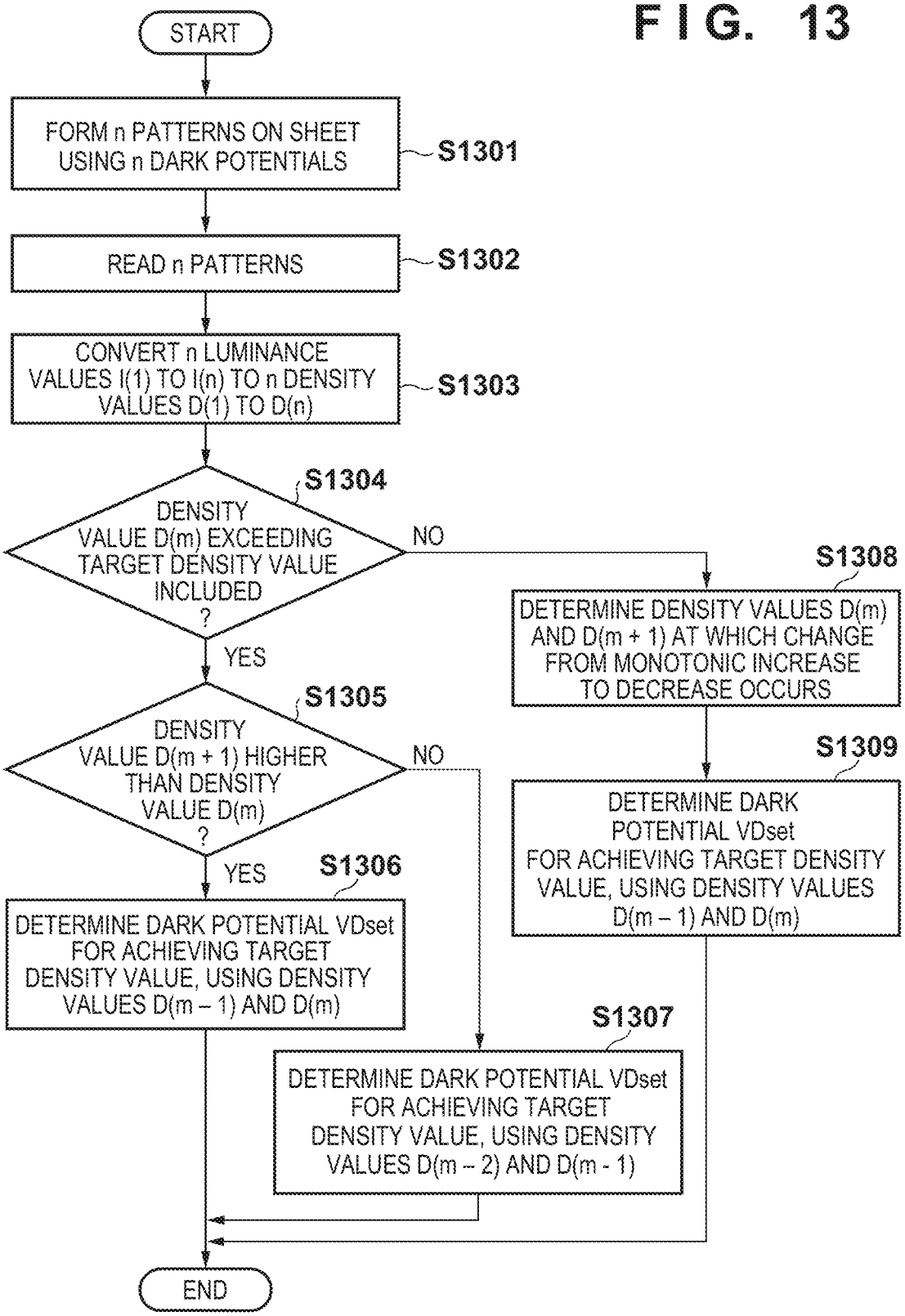
FIG. 13 is a flowchart showing a method of determining a parameter for achieving a target density value.

FIG. 13 is a flowchart showing the process of determining the dark potential (charging voltage) for achieving the target density value, which is performed by the density correction unit 210. In S1301, the density correction unit 210 forms n pattern images using n dark potentials VD(1) to VD(n), on a sheet. For example, the charging voltage setting unit 212 sequentially sets charging voltages Vc(1) to Vc(n) for realizing the dark potentials VD(1) to VD(n), in the high-voltage driver 42. The high-voltage driver 42 applies the designated charging voltage to the charging roller 2. As a result, the surface of the photosensitive drum 1 is charged to the dark potentials VD(1) to VD(n). In detail, the dark potential of one partial area of the surface of the photosensitive drum 1 is VD(1), the dark potential of the next partial area is VD(2), and the dark potential of the last partial area is VD(n). The laser power setting unit 211 sets a constant laser power set value in the laser driver 41, regardless of the dark potentials VD(1) to VD(n). The laser driver 41 causes the laser beam scanner 3 to emit a light beam, using pattern image data and the constant laser power set value. The pattern image data is image data in which pattern images are arranged at regular intervals, as shown in FIG. 12. The electrostatic latent image corresponding to the pattern image 400 is formed on the photosensitive drum 1. The electrostatic latent image is developed by the developer 4, and the toner image as a visible image is primary-transferred to the intermediate transfer belt 51 and then secondary-transferred to the sheet S. The toner image is fixed to the sheet S by the fixing device 80. Thus, the printer unit 10 functions as a pattern image forming unit that forms n pattern images (n is a natural number greater than or equal to 3) respectively corresponding to n parameters on a sheet. In other words, the printer unit 10 varies the charging voltage (dark potential) in n levels as the parameter, to form the n pattern images different in density on the sheet. After this, the operator places the sheet S on the reader unit 20.

In S1302, the density correction unit 210 controls the reader unit 20 to read the n pattern images included in the pattern image 400 formed on the sheet S. The CCD sensor 25 in the reader unit 20 outputs n luminance values I(1) to I(n) to the luminance-to-density conversion unit 201. In S1303, the density correction unit 210 controls the luminance-to-density conversion unit 201 to convert the n luminance values I(1) to I(n) to n density values D(1) to D(n).

In S1304, the density correction unit 210 determines whether or not a density value D(m) exceeding the target density value is included in the n density values D(1) to D(n). Here, the density value D(m) is a density value that first exceeds the target density value. This density value may be easily understood by replacing the laser power set value in FIGS. 7 and 8 with the dark potential. In the case where the density value D(m) exceeding the target density value is included, the density correction unit 210 proceeds to S1305.

In S1305, the density correction unit 210 determines whether or not the density value D(m+1) is higher than the density value D(m). The density value D(m+1) is the density value corresponding to the dark potential VD(m+1) one level lower than the dark potential VD(m) corresponding to the density value D(m). In the case where the density value D(m+1) is higher than the density value D(m), the density correction unit 210 proceeds to S1306. This corresponds to the case (a). In S1306, the density correction unit 210 performs linear interpolation using the density value D(m−1) and the density value D(m), to determine a dark potential VDset corresponding to the target density value. The density value D(m−1) is the density value corresponding to the dark potential VD(m−1) one level higher than the dark potential VD(m) corresponding to the density value D(m).

In the case of determining in S1305 that the density value D(m+1) is not higher than the density value D(m), the density correction unit 210 proceeds to S1307. This corresponds to the case (b). In S1307, the density correction unit 210 performs linear interpolation using the density value D(m−2) and the density value D(m−1), to determine the dark potential VDset corresponding to the target density value. The density value D(m−2) is the density value corresponding to the dark potential VD(m−2) one level higher than the dark potential VD(m−1) corresponding to the density value D(m−1).

In the case of determining in S1304 that the density value D(m) exceeding the target density value is not included, the density correction unit 210 proceeds to S1308. This corresponds to the case (c). In S1308, the density correction unit 210 determines the density values D(m) and D(m+1) at which the change from the monotonic increase to the decrease occurs, from among the n density values D(1) to D(n). In S1309, the density correction unit 210 performs linear interpolation using the density value D(m−1) and the density value D(m), to determine the dark potential VDset corresponding to the target density value. The density value D(m−1) is the density value corresponding to the dark potential VD(m−1) one level higher than the dark potential VD(m) corresponding to the density value D(m).

Thus, the dark potential (charging voltage) of the photosensitive drum 1 may be varied to determine the dark potential for achieving the target density value, while the laser power set value and the developing potential are fixed.

Embodiment 3

In Embodiment 3, the developing potential is varied to determine a developing potential for achieving a target density value, while the laser power set value and the dark potential are fixed. The developing potential setting unit 213 varies the developing voltage applied to the developing sleeve in n levels, as a result of which the printer unit 10 forms n pattern images different in density on a sheet.

Figure 14:
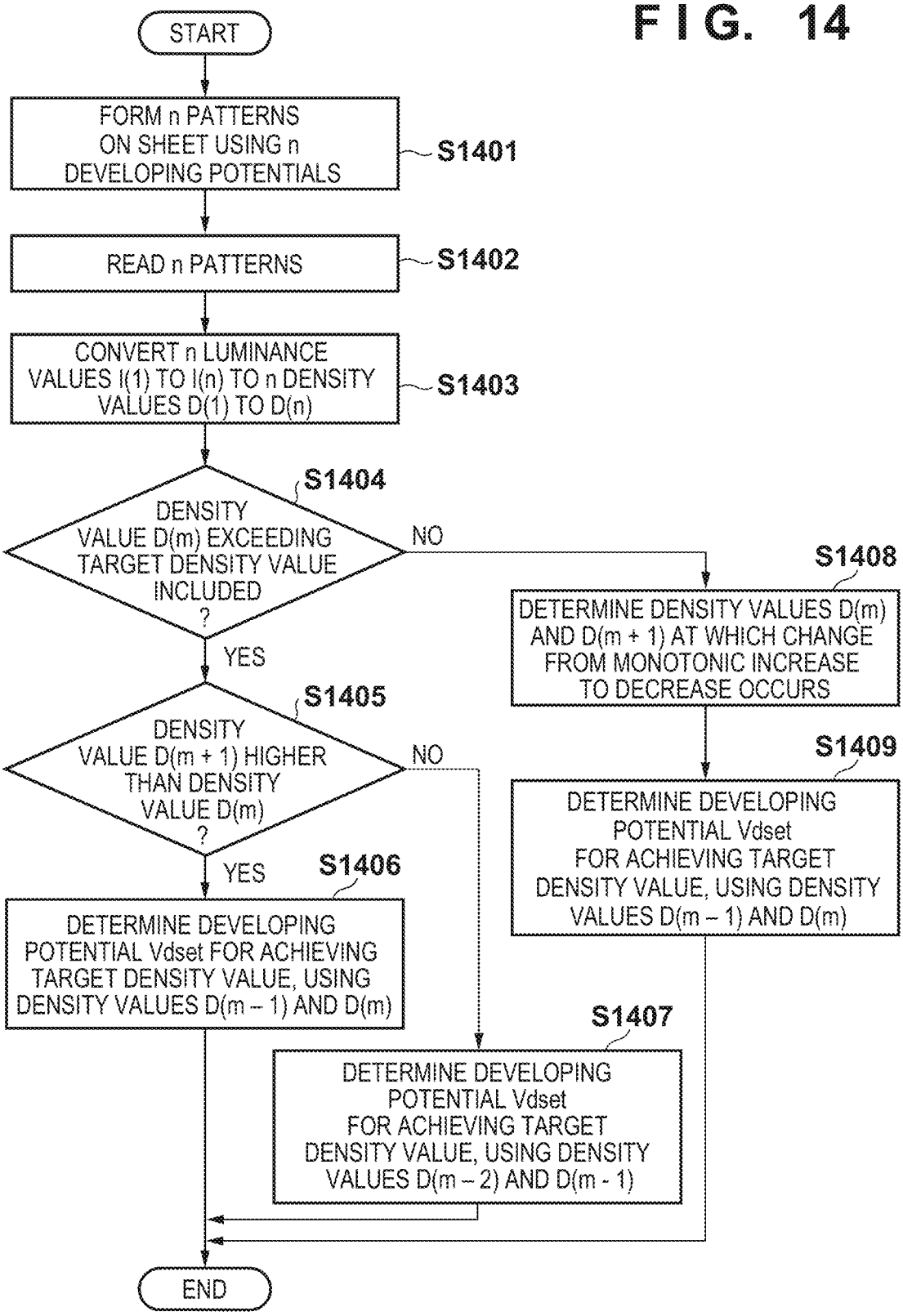
FIG. 14 is a flowchart showing a method of determining a parameter for achieving a target density value.

FIG. 14 is a flowchart showing the process of determining the developing potential for achieving the target density value, which is performed by the density correction unit 210. In S1401, the density correction unit 210 forms n pattern images using n developing potentials Vd(1) to Vd(n), on a sheet. For example, the developing potential setting unit 213 sequentially sets the developing potentials Vd(1) to Vd(n) in the high-voltage driver 42. The high-voltage driver 42 applies a developing voltage for the designated developing potential to the developing sleeve in the developer 4. As a result, the surface of the developing sleeve has the developing potentials Vd(1) to Vd(n). The laser power setting unit 211 sets a constant laser power set value in the laser driver 41, regardless of the developing potentials Vd(1) to Vd(n). Likewise, the charging voltage setting unit 212 indicates a constant charging voltage to the high-voltage driver 42. The laser driver 41 causes the laser beam scanner 3 to emit a light beam, using pattern image data and the constant laser power set value. The pattern image data is image data in which pattern images are arranged at regular intervals, as shown in FIG. 12. The electrostatic latent image corresponding to the pattern image 400 is formed on the photosensitive drum 1. The electrostatic latent image is developed by the developer 4, and the toner image as a visible image is primary-transferred to the intermediate transfer belt 51 and then secondary-transferred to the sheet S. The toner image is fixed to the sheet S by the fixing device 80. Thus, the printer unit 10 functions as a pattern image forming unit that forms n pattern images (n is a natural number greater than or equal to 3) respectively corresponding to n parameters on a sheet. In other words, the printer unit 10 varies the developing potential in n levels as the parameter, to form the n pattern images different in density on the sheet. After this, the operator places the sheet S on the reader unit 20.

In S1402, the density correction unit 210 controls the reader unit 20 to read the n pattern images included in the pattern image 400 formed on the sheet S. The CCD sensor 25 in the reader unit 20 outputs n luminance values I(1) to I(n) to the luminance-to-density conversion unit 201. In S1403, the density correction unit 210 controls the luminance-to-density conversion unit 201 to convert the n luminance values I(1) to I(n) to n density values D(1) to D(n).

In S1404, the density correction unit 210 determines whether or not a density value D(m) exceeding the target density value is included in the n density values D(1) to D(n). Here, the density value D(m) is a density value that first exceeds the target density value. This density value may be easily understood by replacing the laser power set value in FIGS. 7 and 8 with the developing potential. In the case where the density value D(m) exceeding the target density value is included, the density correction unit 210 proceeds to S1405.

In S1405, the density correction unit 210 determines whether or not the density value D(m+1) is higher than the density value D(m). The density value D(m+1) is the density value corresponding to the developing potential Vd(m+1) one level higher than the developing potential Vd(m) corresponding to the density value D(m). In the case where the density value D(m+1) is higher than the density value D(m), the density correction unit 210 proceeds to S1406. This corresponds to the case (a). In S1406, the density correction unit 210 performs linear interpolation using the density value D(m−1) and the density value D(m), to determine a developing potential Vdset corresponding to the target density value. The density value D(m−1) is the density value corresponding to the developing potential Vd(m−1) one level lower than the developing potential Vd(m) corresponding to the density value D(m).

In the case of determining in S1405 that the density value D(m+1) is not higher than the density value D(m), the density correction unit 210 proceeds to S1407. This corresponds to the case (b). In S1407, the density correction unit 210 performs linear interpolation using the density value D(m−2) and the density value D(m−1), to determine the developing potential Vdset corresponding to the target density value. The density value D(m−2) is the density value corresponding to the developing potential Vd(m—2) one level lower than the developing potential Vd(m−1) corresponding to the density value D(m−1).

In the case of determining in S1404 that the density value D(m) exceeding the target density value is not included, the density correction unit 210 proceeds to S1408. This corresponds to the case (c). In S1408, the density correction unit 210 determines the density values D(m) and D(m+1) at which the change from the monotonic increase to the decrease occurs, from among the n density values D(1) to D(n). In S1409, the density correction unit 210 performs linear interpolation using the density value D(m−1) and the density value D(m), to determine the developing potential Vdset corresponding to the target density value. The density value D(m−1) is the density value corresponding to the developing potential Vd(m−1) one level lower than the developing potential Vd(m) corresponding to the density value D(m).

Thus, the developing potential may be varied to determine the developing potential for achieving the target density value, while the laser power set value and the dark potential are fixed.

Embodiment 4

In Embodiments 1 to 3, the pattern image 400 is read using the reader unit 20 which is an image scanner. This requires the operator to place the sheet S ejected from the printer unit 10, on the reader unit 20. Embodiment 4 describes an example of reading the pattern image 400 using an image sensor included in the printer unit 10.

Figure 15:
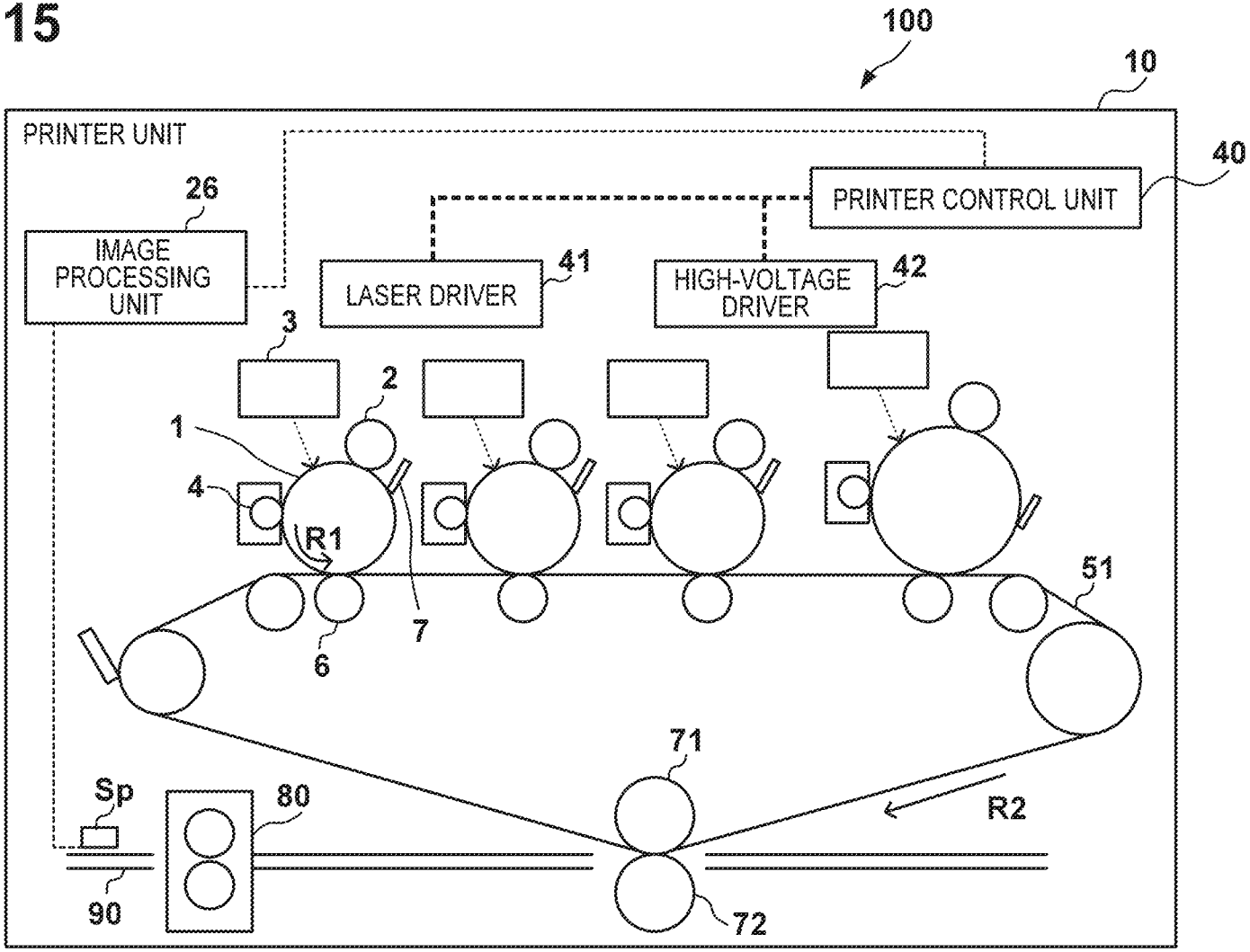
FIG. 15 is a schematic sectional view of an image forming apparatus.

FIG. 15 is a schematic sectional view of the image forming apparatus 100. The image forming apparatus 100 in FIG. 15 differs from the image forming apparatus 100 in FIG. 1 in that the reader unit 20 is omitted and a spectroscopic sensor Sp is added. In addition, the image processing unit 26 that processes an image signal from the spectroscopic sensor Sp is included in the printer unit 10. Alternatively, the spectroscopic sensor Sp may be provided in addition to the reader unit 20.

The sheet S ejected from the fixing device 80 passes through a conveyance path formed by a conveyance guide 90 and is guided to outside the apparatus. The spectroscopic sensor Sp detects the reflection density of the pattern image formed on the sheet S conveyed through the conveyance path in the image forming apparatus 100, and outputs an image signal indicating the reflection density (luminance value) to the image processing unit 26. The spectroscopic sensor Sp includes a light emitting unit and a light receiving unit. The light emitting unit emits light to the sheet S, and the light receiving unit receives part of the light reflected off the sheet S. The luminance-to-density conversion unit 201 in the image processing unit 26 converts n luminance values obtained by the spectroscopic sensor Sp, to corresponding n density values. Thus, the spectroscopic sensor Sp functions as a reading unit that reads n pattern images formed on a sheet to obtain corresponding n luminance values. The other features are the same as those in Embodiments 1 to 3.

In Embodiment 4, the sheet S is read by the spectroscopic sensor Sp, so that the operator's workload can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-172666, filed Aug. 22, 2013 which is hereby incorporated by reference herein in its entirety.

What is claimed is:

1. An image forming apparatus comprising:

an image forming unit configured to form an image based on a process condition;

a control unit configured to control the image forming unit to form a plurality of measurement images based on a plurality of process conditions;

a measurement unit configured to measure density of each of the plurality of measurement images; and a determination unit configured to determine a process condition for the image forming unit to form an image of target density, using a determination mode which includes a first determination mode in which the process condition for the image forming unit to form the image of target density is determined from a first measurement result higher than the target density and a second measurement result lower than the target density, from among a plurality of measurement results of the measurement unit, and a second determination mode in which the process condition for the image forming unit to form the image of target density is determined from measurement results lower than the target density, from among the plurality of measurement results of the measurement unit, wherein the image forming unit includes:

a photosensitive member;

a charging unit configured to charge the photosensitive member;

an exposure unit configured to expose the charged photosensitive member to laser light based on image data, to form an electrostatic latent image; and a developing unit configured to develop the electrostatic latent image, to form an image based on the image data, the process condition is a voltage applied to the charging unit to charge the photosensitive member, the determination unit is configured to determine the process condition using the first determination mode, in the case where a first density measured by the measurement unit is higher than a second density measured by the measurement unit, and determine the process condition using the second determination mode, in the case where the first density is not higher than the second density, the first density is a measurement result for a measurement image formed by the image forming unit when a first voltage is applied to the charging unit, and the second density is a measurement result for a measurement image formed by the image forming unit when a second voltage higher than the first voltage is applied to the charging unit.

2. The image forming apparatus according to claim 1, wherein the determination unit is configured to: perform interpolation using the first measurement result and the second measurement result to determine the process condition, in the first determination mode; and perform extrapolation using the second measurement result to determine the process condition, in the second determination mode.

3. The image forming apparatus according to claim 1, wherein the determination unit is configured to, in the case where the plurality of measurement results of the measurement unit are lower than the target density, determine the process condition using a third determination mode in which the process condition for the image forming unit to form the image of the target density is determined from measurement results lower than the target density.

4. The image forming apparatus according to claim 1, wherein the image forming unit is configured to form, on a sheet, n measurement images respectively corresponding to n process conditions each for defining an amount of applied toner on the sheet, where n is a natural number greater than or equal to 3, the measurement unit is configured to read the n measurement images formed on the sheet, and obtain corresponding n luminance values, and the determination unit is configured to convert the n luminance values to obtain corresponding n density values, and apply linear interpolation in a monotonic increase region of the n density values for the n process conditions used when forming the corresponding n measurement images, to determine the process condition corresponding to the target density.

5. The image forming apparatus according to claim 4, wherein the determination unit is configured to perform the linear interpolation excluding a density value in a non-monotonic increase region from among the n density values.

6. The image forming apparatus according to claim 5, wherein the determination unit is configured to: determine an (m−1)th density value lower than the target density and an mth density value higher than the target density from among the n density values, where m is a natural number greater than or equal to 2 and less than or equal to n−1; compare an (m+1)th density value higher than the mth density value and the mth density value, from among the n density values; and perform the linear interpolation using the (m−1)th density value and the mth density value to determine the process condition corresponding to the target density, in the case where the (m+1)th density value is higher than the mth density value.

7. The image forming apparatus according to claim 5, wherein the determination unit is configured to: determine an (m−1)th density value lower than the target density and an mth density value higher than the target density from among the n density values, where m is a natural number greater than or equal to 3 and less than or equal to n−1; compare an (m+1)th density value higher than the mth density value and the mth density value, from among the n density values; and perform the linear interpolation using an (m−2)th density value one level lower than the (m−1)th density value and the (m−1)th density value to determine the process condition corresponding to the target density, in the case where the (m+1)th density value is lower than the mth density value.

8. The image forming apparatus according to claim 5, wherein the determination unit is configured to, in the case where all of the n density values are lower than the target density, perform the linear interpolation using a last density value in the monotonic increase region and a density value one level lower than the last density value from among the n density values, to determine the process condition corresponding to the target density.

9. The image forming apparatus according to claim 4, wherein the charging unit is configured to be supplied with a predetermined charging voltage, and charge a surface of the photosensitive member to a uniform potential, and the image forming unit is configured to vary power of a light beam of the laser light in n levels to form the n measurement images different in density on the sheet.

10. The image forming apparatus according to claim 4, wherein the charging unit is configured to be supplied with a predetermined charging voltage, and charge a surface of the photosensitive member to a uniform potential, the developing unit is configured to be supplied with a predetermined developing voltage, and develop the electrostatic latent image using toner, and the image forming unit is configured to vary the charging voltage in n levels as the process condition, to form the n measurement images different in density on the sheet.

11. The image forming apparatus according to claim 4, wherein the charging unit is configured to be supplied with a predetermined charging voltage, and charge a surface of the photosensitive member to a uniform potential, the developing unit is configured to be supplied with a predetermined developing voltage, and develop the electrostatic latent image using toner, and the image forming unit is configured to vary the developing voltage in n levels to form the n measurement images different in density on the sheet.

12. The image forming apparatus according to claim 1, wherein the measurement unit is an image scanner.

13. The image forming apparatus according to claim 1, wherein the measurement unit is an image sensor configured to read each measurement image on the sheet that is conveyed through a conveyance path formed in the image forming apparatus.

14. An image forming apparatus comprising:

an image forming unit configured to be controlled based on a process condition and to form an image;

a measurement unit configured to measure a measurement image formed by the image forming unit;

a controller configured to control the image forming unit to form a plurality of measurement images including a first measurement image, a second measurement image, a third measurement image and a fourth measurement image and to control the measurement unit to measure the plurality of measurement images; and a determination unit configured to determine a process condition to be used by the image forming unit based on measurement results of the plurality of measurement images such that a density of the image becomes a target density, wherein the first measurement image is formed by the image forming unit based on a first process condition, the second measurement image is formed by the image forming unit based on a second process condition, the third measurement image is formed by the image forming unit based on a third process condition, the fourth measurement image is formed by the image forming unit based on a fourth process condition, an absolute value of the first process condition is greater than an absolute value of the second process condition, the absolute value of the second process condition is greater than an absolute value of the third process condition, the absolute value of the third process condition is greater than an absolute value of the fourth process condition, and the determination unit is further configured to, in a case where a first density corresponding to a measuring result of the first measurement image is higher than the target value, a second density corresponding to a measuring result of the second measurement image is higher than the target value, a third density corresponding to a measuring result of the third measurement image is lower than the target value, a fourth density corresponding to a measuring result of the fourth measurement image is lower than the third density, and the first density is lower than the second density, determine the process condition using the measuring result of the third measurement image and the measuring result of the fourth measurement image without using the measuring result of the first measuring image and the measuring result of the second measurement image.

15. The image forming apparatus according to claim 14, wherein the determination unit is further configured to determine the process condition using the measuring result of the second measurement image and the measuring result of the third measurement image without using the measuring result of the first measurement image in case where the first density is higher than the second density.

16. The image forming apparatus according to claim 15, wherein the determination unit is further configured to interpolate the process condition corresponding to the target density based on the second process condition, the measuring result of the second measurement image, the third process condition and the measuring result of the third measurement image.

17. The image forming apparatus according to claim 14, wherein the determination unit is further configured to extrapolate the process condition corresponding to the target density based on the third process condition, the measuring result of the third measurement image, the fourth process condition and the measuring result of the fourth measurement image.

18. The image forming apparatus according to claim 14, wherein the image forming unit includes:

a photosensitive member;

a charging unit configured to charge the photosensitive member;

an exposure unit configured to irradiate the photosensitive member with a light beam, to form an electrostatic latent image on the photosensitive member; and a developing unit configured to develop the electrostatic latent image using toner, and wherein the first process condition is a first intensity of the light beam, the second process condition is a second intensity of the light beam, the third process condition is a third intensity of the light beam, and the fourth process condition is a fourth intensity of the light beam.

19. The image forming apparatus according to claim 14, wherein the image forming unit includes:

a photosensitive member;

a charging unit configured to charge the photosensitive member based on a voltage supplied from a power-supply unit;

an exposure unit configured to irradiate the photosensitive member with a light beam, to form an electrostatic latent image on the photosensitive member; and a developing unit configured to develop the electrostatic latent image using toner, and wherein the first process condition is a first voltage supplied from the power-supply unit, the second process condition is a second voltage supplied from the power-supply unit, the third process condition is a third voltage supplied from the power-supply unit, and the fourth process condition is a forth voltage supplied from the power-supply unit.

20. The image forming apparatus according to claim 14, wherein the image forming unit includes:

a photosensitive member;

a charging unit configured to charge the photosensitive member;

an exposure unit configured to irradiate the photosensitive member with a light beam, to form an electrostatic latent image on the photosensitive member; and a developing unit configured to develop the electrostatic latent image using toner, based on a voltage supplied from a power-supply unit, and wherein the first process condition is a first voltage supplied from the power-supply unit, the second process condition is a second voltage supplied from the power-supply unit, the third process condition is a third voltage supplied from the power-supply unit, and the fourth process condition is a forth voltage supplied from the power-supply unit.

* * * * *